United States Patent [19]

Oda et al.

[11] Patent Number: 4,776,192

[45] Date of Patent: Oct. 11, 1988

[54] CONTROLLING THE PROFILE OF SHEET DURING ROLLING THEREOF

[75] Inventors: Takashi Oda; Akio Karato, both of Kitakyushu, Japan

[73] Assignee: Nippon Steel Corporation, Tokyo, Japan

[21] Appl. No.: 921,208

[22] Filed: Oct. 21, 1986

[30] Foreign Application Priority Data

Oct. 21, 1985 [JP] Japan ..... 60-234783

[51] Int. Cl.[4] ..... B21B 37/12; B21B 31/18

[52] U.S. Cl. ..... 72/8; 72/11; 72/13; 72/16; 72/20; 72/21; 72/243; 72/247; 364/472

[58] Field of Search ..... 72/8, 247, 243, 21, 72/365, 366, 199, 11, 12, 13, 16, 20; 364/472

[56] References Cited

U.S. PATENT DOCUMENTS

| | | | |
|---|---|---|---|
| 2,047,883 | 7/1936 | Phillips . | |
| 3,881,335 | 5/1975 | Cook . | |
| 3,882,705 | 5/1975 | Fox . | |
| 4,059,794 | 11/1977 | Furness et al. | 72/247 X |
| 4,648,256 | 3/1987 | Wakamiya | 72/243 X |
| 4,656,855 | 4/1987 | Sakamaki et al. | 72/243 X |

FOREIGN PATENT DOCUMENTS

| | | | |
|---|---|---|---|
| 2392737 | 12/1978 | France . | |
| 2736233 | 2/1978 | Fed. Rep. of Germany . | |
| 53-68662 | 6/1978 | Japan . | |
| 0128304 | 10/1980 | Japan | 72/21 |
| 59-38842 | 9/1984 | Japan . | |
| 0899184 | 1/1982 | U.S.S.R. | 72/21 |

*Primary Examiner*—Robert L. Spruill
*Assistant Examiner*—Steven B. Katz
*Attorney, Agent, or Firm*—Cushman, Darby & Cushman

[57] ABSTRACT

A method of controlling the profile of a sheet material while it is rolled between upper and lower working rolls that can be shifted axially and in opposite directions. The profile of each working roll that varies during the time interval between one changing of the working rolls and another is determined. On the basis of the determined roll profiles, the relationship between the amounts of shifting in the roll position and the configuration of the gap between the upper and lower rolls in the axial direction is determined, so as to determine the amount of shift in the roll position that will provide the smoothest possible configuration for the gap in the axial direction within the area of contact between the work and the working rolls. The upper and lower rolls are shifted axially in accordance with the determination of how to provide the smoothest possible configuration for the gap between rollers.

6 Claims, 8 Drawing Sheets

CONTROLLING THE PROFILE OF SHEET DURING ROLLING THEREOF

BACKGROUND OF THE INVENTION

1. Field of the Invention

The present invention provides a method for controlling the profile of a metal strip such as a steel or aluminum sheet or plate during its rolling.

2. Description of the Prior Art

In rolling a sheet material (workpiece) using equipment having a capability of shifting the positions of working rolls in the axial direction, the following two methods have been proposed for preventing the development of an abnormal profile having a local projection (also referred to as a "high spot") in the work resulting from local wear in the working rolls:

(1) A sheet profile meter is disposed on the delivery end of the final stand in a rolling mill and if, on the basis of the information provided by this profile meter, a sign of local wear in the working rolls or a high spot in the rolled sheet that has resulted from local wear is detected, the pair of working rolls are displaced axially by an amount sufficient to eliminate or reduce the high spot (see, for example, Japanese Patent Publication No. 38842/1984). This method may be implemented with a roll mill having axial shiftable working rolls (see, for example, U.S. Pat. No. 2,047,833, the substance of which is incorporated by reference as if fully set forth herein)

(2) The profiles of the working rolls are first determined and the development of a high spot is prevented by changing axially the relative position of the pass line of the work with respect to the working rolls acting thereon (this practice is conventionally referred to as off-center rolling) such that the rolls will wear uniformly in the axial direction (see, for example, Japanese Patent Laid-Open Publication No. 68662/1978).

The two above-described methods are similar to each other in that they use the profiles of working rolls as a primary control parameter and, by changing the positions of these rolls with respect to the work sheet, they reduce any local wear in a specific area of the rolls in a sufficient amount to provide smooth roll profiles so as to prevent the development of a high spot. The essence of each method is to change the positions of the pair of working rolls relative to the work, namely the positions at which the work contacts the upper and working rolls. In this respect, the two conventional methods differ from the method of the present invention which changes the positions of the upper and lower working rolls individually and in opposite directions.

SUMMARY OF THE INVENTION

The present inventors learned by experimentation that the success of the conventional methods for determining the positions to which the working rolls are shifted in order to provide smoother roll profiles would largely depend on whether the roll profiles themselves are completely smooth at the time when the determination is achieved, and that unless this requirement is met the chance of high spots developing in the work increases rather than decreases. This is because the axial profile of each of the upper and lower working rolls is not smooth and it has the asperity in the axial direction, and the asperity in the profile of the upper roll [see FIG. 1(*a*)] or the lower roll [see FIG. 1(*b*)] has the shape which varies in the axial direction subtly but definitely, respectively. If this shape is not fully taken into account before shifting the positions of the rolls, projections or dips in the upper and lower rolls will overlap each other [i.e., point $P_1$ in FIG. 1(*a*) overlaps point $P_2$ in FIG. 1(*b*)] to produce an undesirable high spot (the amount of high spot produced is manifested as a variation in the sheet thickness across its width). In other words, the operator who has determined the positions to which the working rolls are to be shifted with a view to providing smoother roll profiles will find that, contrary to this intention, the projections or dips in the profiles of the two rolls overlap each other at the same position in the axial direction so as to produce accentuated projections or dips. This phenomenon will be discussed again later in this specification with reference to FIG. 6 it suffices here to mention that the present inventors observed that even when a sheet was rolled with working rolls having the same profile, the smoothness of its profile increased or decreased depending upon the amount in which the roll position was shifted.

If, in accordance with the prior art methods which shift the roll positions with a view to providing smoother roll profiles, the necessary action is taken after the development or any high spot or a sign thereof, smooth roll profiles may be attained after a certain number of workpieces, say, N workpieces, have been rolled, but, on the other hand, this means that the profiles are not smooth before (N−1) articles have been rolled. Therefore, in addition to the previously described problem (i.e. overlapping of projections or dips in upper and lower working rolls), the prior art methods suffer from the disadvantage of prolonged appearance of high spots or a sign thereof.

In addition, the method described in Japanese Patent Publication No. 38842/1984 is comparatively slow in its responsiveness because an undesired sheet having high spots has already been produced by the time its profile is actually measured and because such abnormal spots will continue to exist until appropriate roll positions are determined by shifting their positions based on the results of the measurement. This method assumes that local wear will occur at a limited number of positions of rolls and that by shifting the roll positions the area of contact between the rolls and the sheet can be undated for a smooth surface having no local wear. However, in modern rolling mills, the practice of "schedule-free rolling operation" is becoming increasingly popular; according to this practice, the order of rolling sheets is not dependent on their width and they are rolled in the decreasing order of width or vice versa during the interval between one changing of rolls and another. In this kind of rolling operation, updating for a wear-free smooth surface is not always ensured by shifting the positions of the working rolls.

As will be understood from the above explanation, none of the conventional methods which take only the roll profiles as a control parameter and which shift the positons of working rolls for providing smoother roll profiles are capable of completely and consistently preventing the development of high spots.

During their experimentation, the inventors tried to shift the upper and lower working rolls axially in opposite directions. The amounts of shift in the roll positions were either randomly selected or fixed to a predetermined stroke (e.g. 10 mm) and the development of large high spots was unavoidable (as will be shown later in the specification by a comparison between this approach and the method of the present invention).

It therefore becomes necessary to first determine the roll profiles before starting to roll a sheet material and then roll the material with the positions of upper and lower working rolls being shifted in sufficient amounts to achieve a smoother roll gap by synthesizing the profiles of the two rolls. In order to meet this need, the present invention provides a method which is capable of rolling sheets ranging in width from about 100 to about 600 mm, with broad sheets being rolled first and narrow sheets rolled subsequently or vice versa, and which prevents the development of any abnormal sheet profile in the transverse direction including abnormal projections.

The profile of a sheet material is controlled while it is rolled with the positions of upper and lower working rolls being shifted axially and in opposite directions. The profile of each working roll that varies during the time interval between one changing of the working rolls and another is determnned. On the basis of the determined roll profiles, the relationship between the amount of shifting in the roll position and the configuration of the gap between the upper and lower rolls in the axial direction is determined, so as to determine the amount of shift in the roll position that will provide the smoothest possible configuration for the gap in the axial direction within the area of contact between the work and the working rolls.

BRIEF DESCRIPTION OF THE DRAWINGS

FIG. 1(*b*) shows the profile function of a lower working roll;

FIG. 3(*b*) is an enlarged view of portion A of FIG. 3(*a*);

FIG. 3(*c*) is a diagram showing the maximum wavelength and amplitude of a wave occuring within an average interval having a width of $2\beta$;

DETAILED DESCRIPTION OF THE INVENTION

Figure 1:
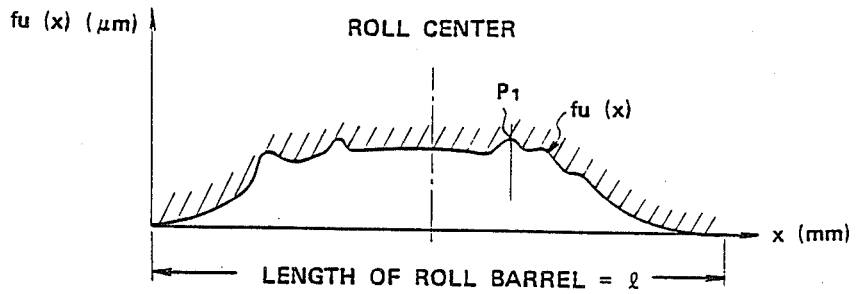
FIG. 1(*a*) shows the profile function of an upper working roll.
Figure 1:
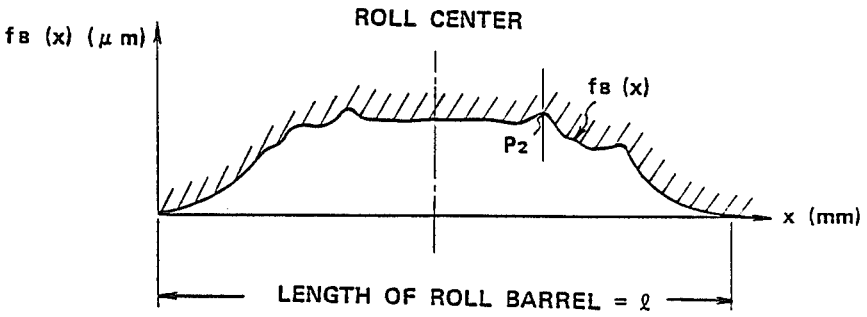

The invention may be implemented as follows. First, the profiles of working rolls that experience variations during the process of rolling are measured on-line or determined by high-precision predictive calculation, and the obtained data is expressed in terms of roll profile functions, fu(x) for the upper working rolls and fB(x) for the lower working rolls, as shown in FIG. 1(*a*) and (*b*), respectively. In the two profile functions, x denotes a position on the barrel length of each working roll. The profiles of the working rolls may be determined directly by any known on-line method employing a water micrometer which detects an electrical resistance in water, a distance meter which uses the effect of an eddy current, or a contact potentiometer.

When the roll profiles are determined by predictive calculation, the thermal expansion of the rolls are first determined by the finite element method (FEM) based on the roll temperature which is estimated from the measured value of the temperature of the strip emerging from, for example, the final stand (even if the temperature of the strip is measured at any place concerning any one of stands, the roll temperature of each of the other stands can be estimated from the measured value, for example, if the temperature of the strip is measured in front of a stand No. 1, the roll temperature of each of stands No. 2 to 6 may be estimated from the measured value; such measuring may be conducted reversely in front of each of the stands No. 2 to 6; the more the number of the measuring is, the higher the accuracy of the roll temperature estimated is, so if the measuring is conducted concerning all of the stands, the best data can be obtained), the calculated thermal expansion then being synthesized with a calculated value of roll wear at the portions which are in contact with the sheet edges determined by dependent on the applied rolling load and the length to be rolled). The results of synthesis may be verified and fed back for the purpose of increasing the precision of estimation of the roll profile by the following method: a gage meter gage is calculated by means of a gage meter formula from the recorded history of reaction force as detected by a load cell; a mass flow gage is detected by a thickness meter; the difference between the gage meter gage and the mass flow gage is determined; the difference is used to determine the actual value of the synthesis of roll wear and thermal expansion at the roll center; and this actual value is compared with the calculated value.

Figure 2:
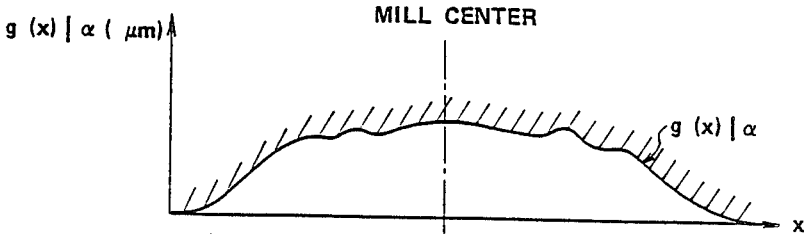
FIG. 2 shows a gap function as between the upper and lower working rolls.

The two roll profile functions fu(x) and fB(x), are then used to obtain a roll gap function, $g(x)|\alpha$ as shown in FIG. 2, which is defined as follows (typical numerical operating data are shown in brackets after each symbol but are not intended to limit the scope of the present invention):

$$g(x)|\alpha = fu(x+\alpha) + fB(x-\alpha) (0 \leqq x \leqq l)$$

where fu(x), fB(x): the profile functions of upper and lower working rolls;

$\leq \alpha \leq$ the amount of shift in roll position ($-75$ mm $+$ $75>$ mm); $g(x)|\alpha$: roll gap at point x for a given amount of $\alpha$.

Figure 3:
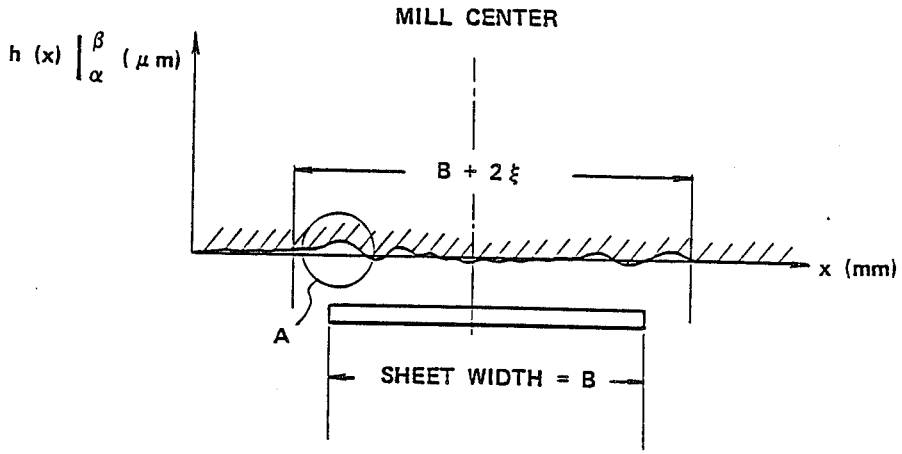
FIG. 3(*a*) shows an asperity function for a given amount of shift in the working rolls and for a given point on the upper and lower rolls.
Figure 3:
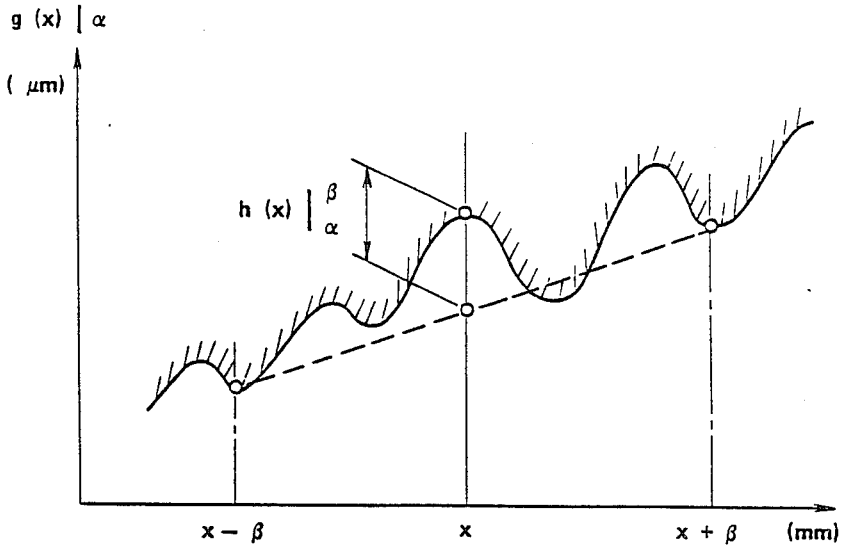
Figure 3:
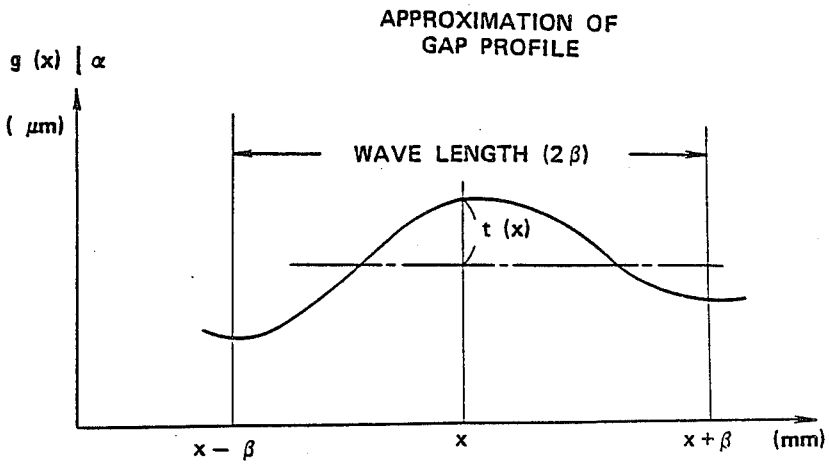

In the next step, an asperity function $h(x)|_{\alpha}{}^{\beta}$ at a given point on the upper or lower roll for a given amount of $\alpha$ is obtained within the range of contact between each working roll and the sheet: an example of this asperity function is shown in FIG. 3(*a*), and an enlarged view of portion A in FIG. 3(*a*) is shown in FIG. 3(*b*):

$$h(x)|_{\alpha}^{\beta}=g(x)|\alpha-\tfrac{1}{2}\{g(x-\beta)|\alpha+g(x+\beta)|\alpha\}$$

where $\beta$: distance from point x on the roll axis [see FIG. 3(*b*)], or width used to determine an average interval for $g(x)|\alpha$ ($\beta=100$ m); $h(x)|_{\alpha}^{\beta}$: the amount of asperity at point x between upper and lower rolls for given amounts of $\alpha$ and $\beta$.

The function $h(x)_{\alpha}^{\beta}$ assumes that the configuration of the roll gap profile attained by shifting the positions of the working rolls by an amount of $\alpha$ can be expressed as a synthesis of many waves having various wavelengths and amplitudes, and this function provides an approximate value of 2t(x) in the neighborhood of a selected point for a wave with a wavelength of $2\beta$ wherein t(x) signifies the amplitude of the wave [see FIG. 3(*c*)].

Obtain $hmax|_{\alpha}^{\beta}$, or a maximum absolute value of $h(h)|_{\alpha}^{\beta}$ for a given amount of $\beta$ within the range defined by the following relation:

$$(l-B)/2-\xi\leqq x\leqq(l+B)/2+\xi$$

where l: where the length of roll barrel (l=1680 mm);

B: the width of sheet (b=1000 mm);

$\xi$: the amount of lateral vibration of the sheet during its rolling ($\xi=30$ mm).

The function $humax|_{\alpha}^{\beta}$ represents a maximum value of $h(x)_{\alpha}^{\beta}$ when the latter is determined for a given value of $\alpha$ by varying the values of x and $\beta$ within certain limits. Determine the value of $\alpha$ which minimizes the value of $hmax|_{\alpha}^{\beta}$ or $\eta(\alpha,\beta)\cdot hmax|_{\alpha}^{\beta}$ obtained by multiplying $hmax|_{\alpha}^{\beta}$ a weighting coefficient $\eta(\alpha,\beta)$ which is determined from $\alpha$ and $\beta$. Alternatively, determine the value of $\alpha$ which provides a value of $hmax|_{\alpha}^{\beta}$ *or* $\eta^{(\alpha,\beta)\cdot hmas}|_{\alpha}^{\beta}$ whose difference from the minimum absolute value does not exceed $\epsilon$. Such value of $\alpha$ can be used as the amount of shift in roll position which is necessary for achievpresent invention.

In the above description, e is the margin of tolerance for a smoothness evaluation function that is determined from the estimated precision of a roll profile or from the limit on abnormal profile that should be met by the final product. If the absolute value of the difference between two values of $hmax|_{\alpha}^{\beta}$ for two positions to which each working roll has been shifted is not greater than $\epsilon$, the roll gaps at the two positions can safely be regarded as being equally smooth. The procedures for determining the optimum amount of shift in roll position in accordance with the present invention are specifically shown by the flowchart in FIG. 4.

Not all of the sheets having abnormal profiles are rejected and those which contain tolerable levels of abnormality will of course be accepted as the final product. In order to work as many sheets as possible with a single roll, it is sometimes more economical to achieve uniformity in roll wear and to distribute the expected thermal crown than to ensure an increase in the smoothness of the roll gap profile. Therefore, with a view to attaining the best compromise between these requirements, the operator may well select a method that provides for roll shifting by achieving uniformity in roll wear and distributing the expected thermal crown to the extent where no substantial effects are caused on the quality of the final product. This extent is signified by $\xi$.

If $\epsilon$ is not zero, or depending upon the value assigned to $\epsilon$, a plurality of values may exist for the optimum amount of roll shifting, $\alpha$. The procedures for selecting the most appropriate value of $\alpha$ are described below.

Obtain for each value of $\alpha$ the values which cause the least wear in roll at sheet edges as follows:

$$Mu(\alpha)=\max\left\{fu\left(\frac{l-B}{2}-\alpha\right),fu\left(\frac{l+B}{2}+\alpha\right)\right\}$$

$$\left(\text{or } Mu(\alpha)=\tfrac{1}{2}\left\{fu\left(\frac{l-B}{2}-\alpha\right)+fu\left(\frac{l+B}{2}+\alpha\right)\right\}\right);$$

$$MB(\alpha)=\max\left\{fB\left(\frac{l-B}{2}-\alpha\right),fB\left(\frac{l+B}{2}+\alpha\right)\right\}$$

$$\left(\text{or } MB(\alpha)=\tfrac{1}{2}\left\{fB\left(\frac{l-B}{2}-\alpha\right)+fB\left(\frac{l+B}{2}+\alpha\right)\right\}\right).$$

From these values, determine the following:

$$M(\alpha)=\max\{Mu(\alpha),MB(\alpha)\}$$

where max (v, w) signifies whichever the greater of two variables, v and w, $Mu(\alpha)$ represents a function for evaluating the amount of wear in the upper roll which contacts the edges of a sheet of a width B when the amount of the shift in roll position is $\alpha$, and $MB(\alpha)$ is the same as $Mu(\alpha)$ except that the roll of interest is the lower roll.

Therefore, $M(\alpha)$ represents a function for evaluating the amount of wear for roll shifting of $\alpha$ as determined from $Mu(\alpha)$ and $MB(\alpha)$. The greater the absolute value of $Mu(\alpha)$, $MB(\alpha)$ or $M(\alpha)$, the more extensive the roll wear.

Determine the value of $\alpha$ which minimizes $M(\alpha)$ or which provides a value whose absolute difference from the minimum value does not exceed $\delta$. If a plurality of such values exist for $\alpha$ depending upon the value assigned to $\delta$, (e.g. $\delta\neq0$), obtain a value that satisfies max-$|\alpha_o-\alpha|$ where $\alpha_o$ is the amount of shift in roll position that was achieved in a preceding cycle of rolling operation. The so determined value of $\alpha$ is an optimum amount of roll shifting that will provide uniform distribution of roll wear and thermal load and which yet ensures the production of a smooth gap profile. Like $\epsilon$, $\delta$ is the margin of tolerance for the evaluating function $M(\alpha)$ which is determined from the predicted precision of roll profiles.

Figure 5:
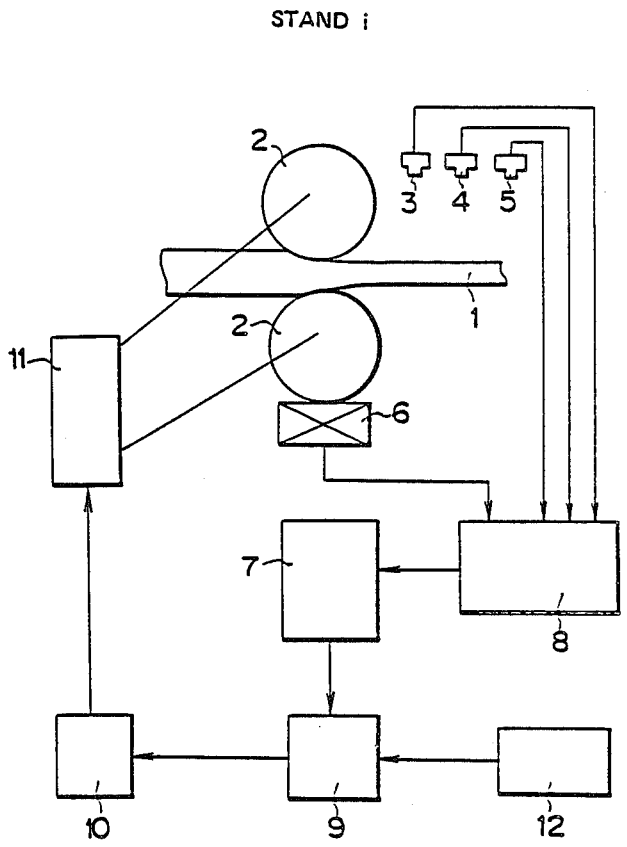
FIG. 5 is a diagram illustrating a control block that may be used implement the method of the present invention.

A system layout for finish rolling a hot strip on a tandem mill in accordance with the present invention is shown in FIG. 5. Although the tandem mill contains a plurality of stands, only an arbitrary stand i is shown in FIG. 5.

Data showing the past history of rolling of a workpiece 1 are gathered by means of detection terminals such as a width gage 3, a thermocouple 4, a thickness gage 5 and a load cell 6, and combined with the history of previous rolling operations and the roll information obtained from a roll diameter information input unit 8. The combined data is fed into an arithmetic manipulating unit 7 so as to attain precise profiles for both the upper and lower working rolls. The roll profiles are then fed into a roll shift manipulating unit 9 which determines an optimum amount of shift in the positions of upper and lower working rolls in accordance with the flowchart shown in FIG. 4 and on the basis of the information provided by a unit 12 for inputting information about the rolling of subsequent work. The so determined sequent work presetting buffer 10 and held there until is used in the execution by a roll shifting unit 11 immediately before the rolling of subsequent work.

The above-described steps are executed at each of the stands in the tandem mill during the interval between one roll changing and another. Stated more specifically, the changes in the roll profiles for each stand are stored after being processed by the arithmetic manipulation unit 7 on the basis of the history of previous rolling operations and the information obtained from the unit 8. In achieving roll changing, care should be taken to avoid any disagreement between the heretofore stored roll profiles and those which are to be employed in the process of rolling subsequent to the roll changing. In order to meet this requirement, the roll profiles stored in unit 7 at the stand where roll changing is to be achieved must be initialized so that they will match the roll profiles to be loaded.

Figure 6:
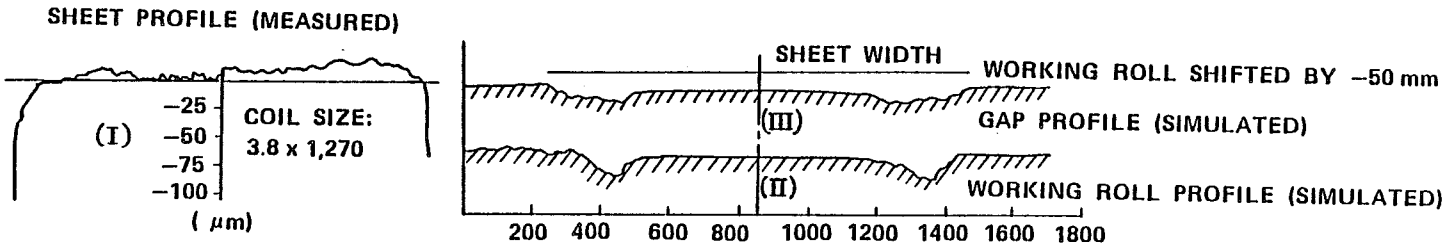
FIG. 6(*a*) and (*b*) show in graphic from the relationship between the measured profiles of two sheets (I) that were rolled successively, the simulated profiles of working rolls (II) in the final stand in a finishing mill, and the simulated profiles of gap (III) between the upper and lower working rolls, with FIG. 6(*a*) showing the results obtained by practicing the method of the present invention, and FIG. 6(*b*) showing the results obtained by a method outside the scope of the present invention.
Figure 6:
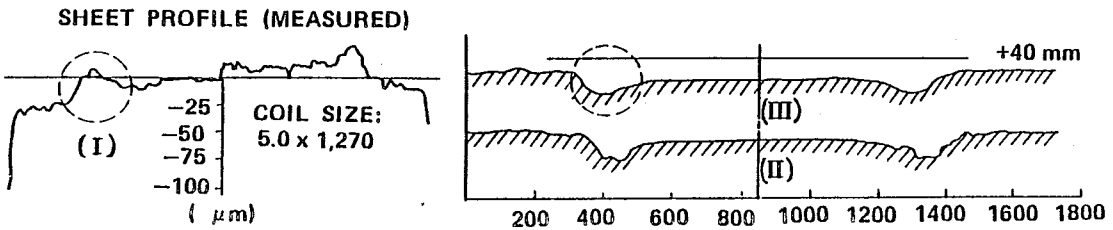

FIG. 6(*a*) and (*b*) show the results of continuous rolling of two sheets of the same width (1,270 mm) on a finishing mill. Each graph shows the relationship between a measured profile of the sheet (I), a simulated profile of a working roll in the final stand of the mill (II), and a simulated gap profile (III) for the gap between upper and lower working rolls. The sheet shown in FIG. 6(*a*) had a thickness of 3.8 mm and the sheet in FIG. 6(*b*) was 5.0 mm thick. Since the two sheets were rolled continuously, they can safely be regarded as having the same working roll profiles (II).

Figure 4:
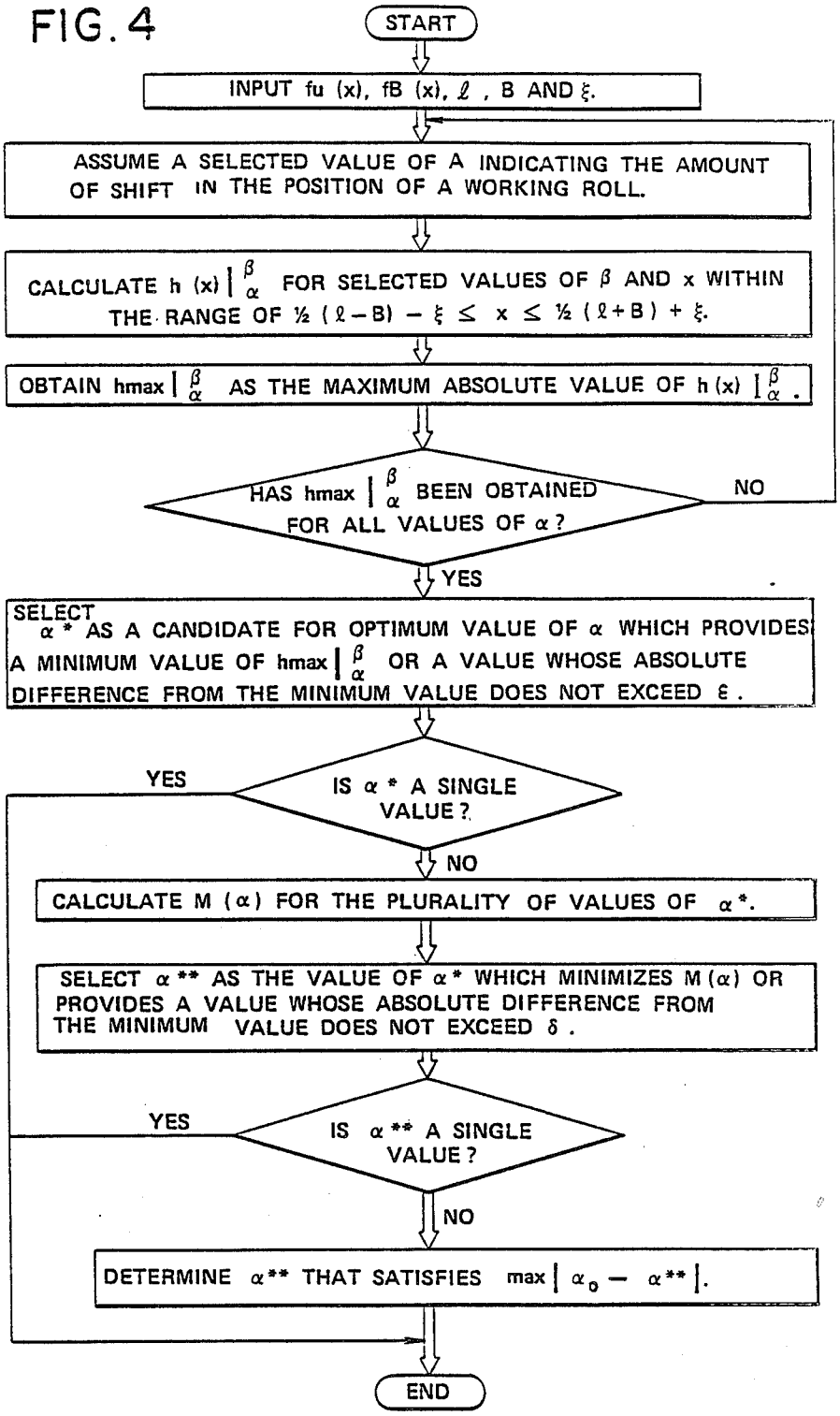
FIG. 4 is a flowchart showing the sequence of steps for determining an optimum amount of shift, $\alpha$, in the positions of the working rolls in accordance with the present invention.

FIG. 6(*a*) clearly shows that according to the investigation of the relationship between the roll gap and the amount of shift in the roll position that was undertaken in accordance with the flowchart presented in FIG. 4, the amount of roll shifting that would provide the smoothest roll profile is −50 mm and that if the roll position is shifted by this amount the roll gap will provide a smooth profile (III) even at the sheet edges.

In FIG. 6(*a*), the position of the working rolls before they are shifted is indicated at 0 and the direction of the shifting of the upper roll is indicated by plus sign (+) when it is moved toward the mill motor and by minus sign (−) when it is moved away from the motor (the signs are reversed for the lower roll). Therefore, FIG. 6(*a*) assumes that the upper roll was shifted by 50 mm to depart from the mill motor. The results of the rolling operation in accordance with the method of the present invention were of course satisfactory as manifested by the smooth sheet profile (I).

FIG. 6(*b*) shows the results of a rolling operation that was performed without employing the method of the present invention but by shifting the roll position by +40 mm. Since the selection of this value was not appropriate, the roll gap profile (III) contained portions that accentuated dips in the working rolls and the sheet profile (I) obtained contained an abnormal projection (as encircled by a dashed line) that corresponded to a dip in the roll gap profile (as encircled by a dashed line).

Figure 7:
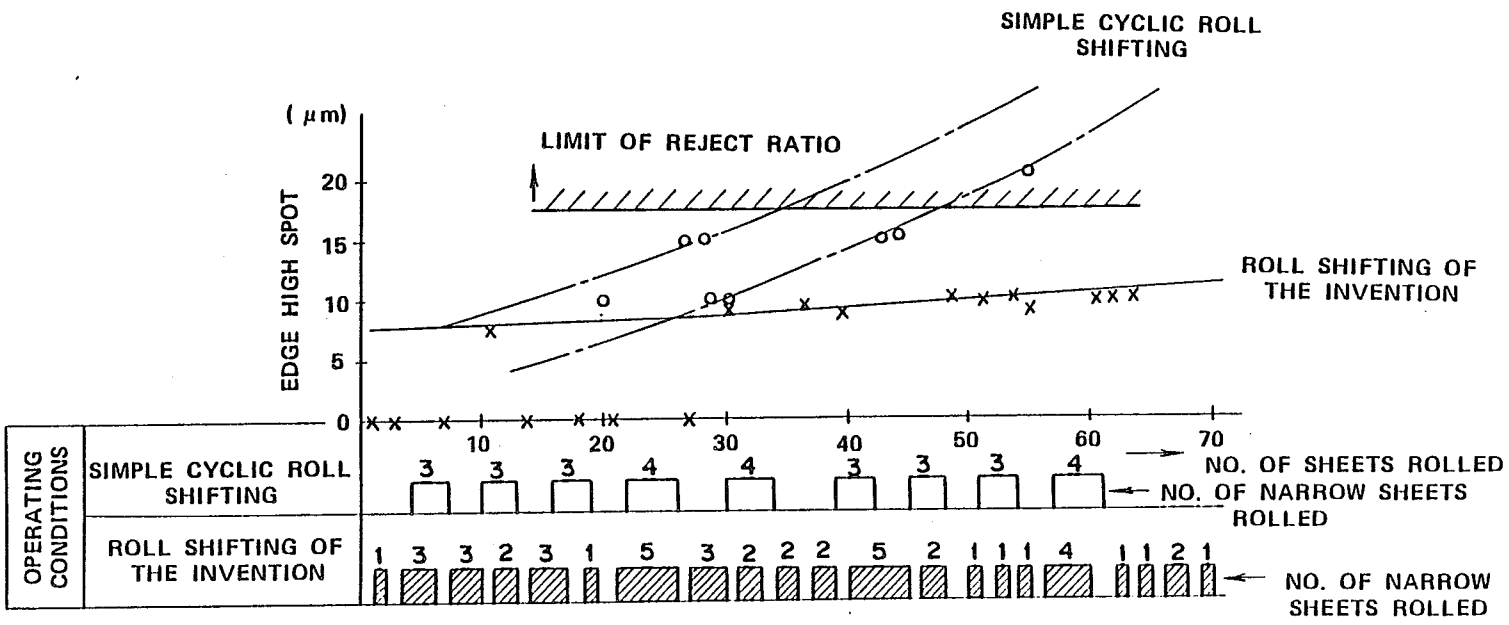
FIGS. 7 and 8(*a*) and (*b*) are graphs depicting the advantages of the present invention over a conventional method.
Figure 8:
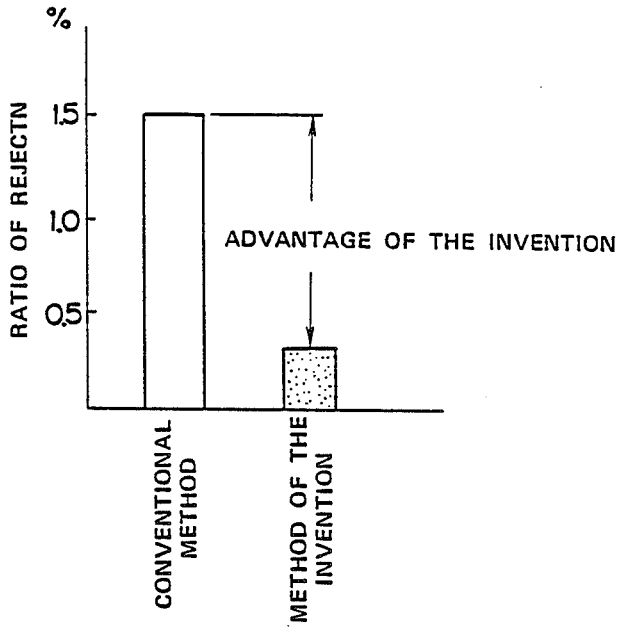
Figure 8:
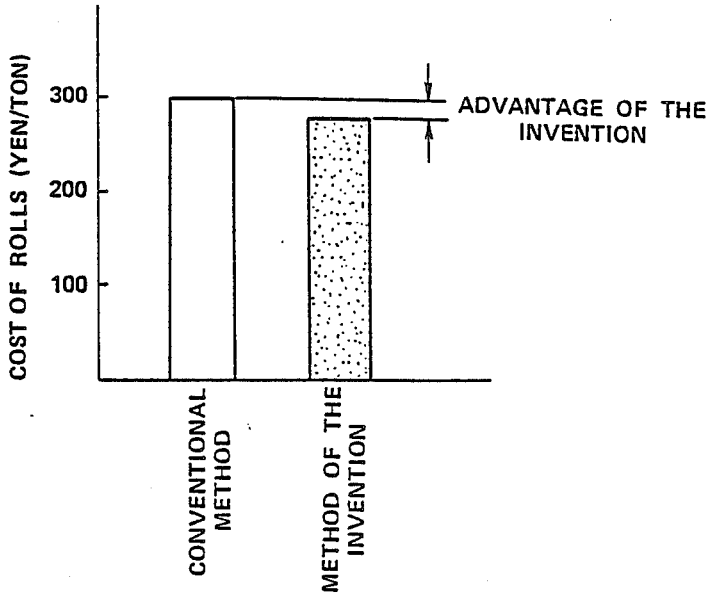

FIGS. 7 and 8 show the results of a rolling operation wherein hot strips ranging in width from 100 to 600 mm were rolled without specifying the order of sheet passes.

FIG. 7 shows the quantities of high spots that developed on the edges of broad strips when they were rolled by two methods, one involving simple cyclic shifting in the roll position and the other employing the concept of the present invention. One can see from the data in FIG. 7 that the method of the present invention is capable of consistent rolling operation wherein the reject ratio of rolled strips was well below the tolerable limit. As a result, the incidence of the production of unacceptable products due to the development of edge high spots is drastically reduced by employing the method of the present invention (see FIG. 8). In addition, the interval between one roll changing and another is sufficiently extended so as to reduce the cost of rolls by as much as about 10–20% (see FIG. 8).

In accordance with the present invention, the positions of upper and lower working rolls are shifted prior to rolling by such amounts that the asperity in the profile of the gap between the two rolls can be minimized within the area of contact between the work and each roll. Therefore, sheets having different widths can be consistently rolled without producing any abnormal sheet profiles and the quality of all the products attained is well below the tolerable limit of reject ratio. In addition, the interval between one roll changing and another can be sufficiently extended to achieve a substantial reduction in the cost of working rolls.

An even better result can be attained by the present invention if the positions of the upper and lower working rolls are shifted in opposite directions to each other after the pair of rolls is shifted en masse as in the prior art to change the positions at which they contact the work.

What is claimed is:

1. A method of controlling the profile of a sheet material workpiece rolled by upper and lower working rolls comprising the steps of:

first determining the profile in the axial direction of each working roll that varies during the time interval between one changing of the working rolls and another;

second determining on the basis of the determined roll profiles, the relationship between the amounts of shifting in the roll position and the configuration of the gap between the upper and lower rolls in the axial direction, so as to determine the amount of shift in the roll position that will provide the smoothest possible configuration for said gap in the axial direction within the area of contact between the work and the working rolls; and shifting the positions of the upper and lower working rolls axially and in opposite directions in accordance with the amount of shift determined to provide the smoothest possible configuration for said gap in the axial direction.

2. A method according to claim 1 wherein said first determining step comprises the step of determining the profiles of the upper and lower working rolls in terms of roll profile functions, fu(x) and fB(x), respectively, and wherein said second determining step comprises the step of obtaining from said two roll profile functions a roll gap function, $g(x)|\alpha$, which is defined as follows:

$$g(x)|\alpha - fu(x+\alpha) + fB(x-\alpha) \quad (0 \leqq x \leqq l)$$

(where $\alpha$ is the amount of shift in roll position and l (wherein $\alpha$ is the amount of shift in roll position and l is the amount of shift in roll position and is the length of the roll barrel), so as to determine the relationship between the amount of shift in roll position and the configuration of the gap between the upper and lower working rolls.

3. A method according to claim 1 or 2 which further includes the following steps:

obtaining an asperity function $h(x)|_\alpha{}^\beta$ defined below, for the profile of the gap between the upper and lower working rolls, at a given point x on the upper or lower roll for a given amount of $\alpha$ within the range of contact between each working roll and the sheet for a given average interval, $\beta$, from point x:

$$h(x)|_\alpha{}^\beta = g(x)|\alpha - \tfrac{1}{2}\{g(x-\beta)|\alpha + g(x+\beta|\alpha\};$$

obtaining $hmax|_\alpha{}^\beta$, or a maximum absolute value of $h(x)|_\alpha{}^\beta$ for given amounts of $\beta$ and x within the range defined by the following relation:

$$(1-B)/2-\zeta \leqq x \leqq)(1+B)/2+\zeta$$

where l is the length of roll barrel, B is the width of the sheet, and $\zeta$ is the amount of lateral vibration of the sheet during its rolling; and determining the value of $\alpha$ which minimizes the value of $hmax|_\alpha{}^\beta$ or $\eta(\alpha, \beta)\cdot hmax_\alpha{}^\beta$ obtained by multiplying $hmax|_\alpha{}^\beta$ by a weighting coefficient $\eta(\alpha, \beta)$ which is determined from $\alpha$ and $\beta$, or determining the value of $\alpha$ which provides a value of $hmax|_\alpha{}^\beta$ or $\eta(\alpha, \beta)\cdot hmax|_\alpha{}^\beta$ whose difference from the minimum absolute value does not exceed $\epsilon$ which is the margin of tolerance for a smoothness evaluation function that is determined from the estimated precision of a roll profile or from the limit on abnormal profile that should be met by the final product, so as to determine the amount of shift in the roll position that will provide the smoothest possible configuration for said gap in the axial direction within the area of contact between the work and the working rolls.

4. A method according to claim 3 wherein if a plurality of values of $\alpha$ are obtained by the mathematical operations described in claim 3, selecting the one causing the least wear in the rolls at the sheet edges.

5. A method according to claim 3 wherein if a plurality of values of $\alpha$ are obtained by the mathematical operations described in claim 3, selecting one providing a maximum difference from the position of roll shifting that was attained in a preceding cycle of rolling operation.

6. A method according to claim 1 wherein the positions of the upper and lower working rolls are shifted in opposite directions after they have been shifted en masse to change the positions at which they contact the workpiece.

* * * * *

UNITED STATES PATENT AND TRADEMARK OFFICE

CERTIFICATE OF CORRECTION

PATENT NO. : 4,776,192

DATED : October 11, 1988

INVENTOR(S) : Takashi ODA; Akio KARATO

It is certified that error appears in the above-identified patent and that said Letters Patent is hereby corrected as shown below:

IN THE CLAIMS:

Column 9, line 6, change

"$g(x)|\alpha - fu(x + \alpha) + fB(x - \alpha)$ $(0 \leq x \leq 1)$" to

-- $g(x)|\alpha - fu(x + \alpha) + fB(x- \alpha)$ $(0 \leq x \leq \ell)$ --;

line 9, change "1" to -- $\ell$ --;

lines 10-11, delete "(wherein $\alpha$ is the amount of shift in roll position and 1 is the amount of shift in roll position and";

lines 22 and 26, change "x" to -- $\underline{x}$ --;

line 34, change

"$(1 - B)/2 - \xi \leq x \leq )(1 + B)/2 + \xi$" to

-- $(\ell - B)/2 - \xi \leq x \leq (\ell + B)/2 + \xi$ --.

UNITED STATES PATENT AND TRADEMARK OFFICE

CERTIFICATE OF CORRECTION

PATENT NO. : 4,776,192

DATED : October 11, 1988

INVENTOR(S) : Takashi ODA; Akio KARATO

It is certified that error appears in the above-identified patent and that said Letters Patent is hereby corrected as shown below:

Column 10, line 1, change "1" to -- ℓ --.

Signed and Sealed this

Thirtieth Day of May, 1989

*Attest:*

DONALD J. QUIGG

*Attesting Officer*

*Commissioner of Patents and Trademarks*